United States Patent [19]

Fuchs, Jr.

[11] 3,950,979

[45] Apr. 20, 1976

[54] APPARATUS AND METHOD FOR TUBE EXTRUSION

[75] Inventor: Francis Joseph Fuchs, Jr., Princeton Junction, N.J.

[73] Assignee: Western Electric Company, Inc., New York, N.Y.

[22] Filed: Oct. 4, 1974

[21] Appl. No.: 512,270

[52] U.S. Cl. ..... 72/370; 72/60; 72/264; 72/265

[51] Int. Cl.[2] ..... B21B 17/02

[58] Field of Search ..... 72/264, 265, 268, 42, 72/266, 56, 60, 367, 368, 370

[56] References Cited

UNITED STATES PATENTS

| | | | |
|---|---|---|---|
| 2,063,563 | 12/1936 | Sparks | 72/265 |
| 3,454,495 | 7/1969 | Schneider | 72/42 |
| 3,526,119 | 9/1970 | Wasser | 72/264 |
| 3,677,048 | 7/1972 | Fuchs | 72/60 |
| 3,807,032 | 4/1974 | Nilsson | 72/60 X |
| 3,808,860 | 5/1974 | Yamaguchi et al. | 72/60 |

*Primary Examiner*—C. W. Lanham
*Assistant Examiner*—James R. Duzan
*Attorney, Agent, or Firm*—D. P. Kelley; A. S. Rosen

[57] ABSTRACT

A chamber having a first end and a second end and receiving a billet having an aperture therethrough slidably receives through the first end a die. A mandrel slidably extends through the second end of the chamber into the aperture of the billet and has a conical section extending into the zone of deformation of the die. Hydraulic cylinders having piston rods operatively associated with the die and the mandrel advance the die into the chamber through the first end thereof against the billet end, and simultaneously and at the same velocity retract the mandrel from the second end of the chamber, the zone of deformation of the die and the conical section of the mandrel defining a converging annular passageway through which the billet is extruded to produce tubing. Another set of hydraulic cylinders is operatively interposed between the die and the mandrel to compensate for forces tending to separate the die and mandrel during extrusion of the billet therethrough, whereby to maintain the positions of the die and mandrel relative to each other fixed and thus to maintain constant the geometry of the annular passageway.

14 Claims, 3 Drawing Figures

APPARATUS AND METHOD FOR TUBE EXTRUSION

BACKGROUND OF THE INVENTION

1. Field of the Invention

This invention relates, broadly speaking, to improvements in apparatus and method for extruding material. More specifically, this invention relates to apparatus and method for producing tubing from a pierced billet.

2. Description of the Prior Art

Many methods and apparatus for making tubing are well known, such as the conventional tube making by drawing technique.

Another conventional technique for making tubing involves filling the hole of a pierced billet with a plug, and thereafter reducing by extrusion the diameter of the composite structure, the difficulty in this method being the removal of the plug from the hole after extrusion.

U.S. Pat. No. 3,362,208 (1968) to Murphy discloses method and apparatus for making tubing wherein a solid (i.e., unperforated) billet is placed in a chamber adjacent a flat die with a cylindrical throat, a mandrel is forced through the chamber into and through the billet and into the throat of the die so as to provide a cylindrical annular passageway between the tip of the mandrel and the die. Thereafter, a ram is advanced into the chamber, surrounding the mandrel, and forcing the billet material through the annular passageway between the tip of the mandrel and the die to produce tubing. Means are provided to maintain the mandrel tip in the die against forces tending to expel the mandrel tip from the die.

U.S. Pat. 2,415,696 (1947) to Klocke discloses method and apparatus for making tubing wherein a solid (i.e., unperforated) billet is placed in a chamber above a die, a punch or mandrel is forced through the chamber into and through the billet and into the die (there being clearance between the die aperture and the punch so as to provide an annular opening through which annular opening some of the billet material is extruded as tubing), and thereafter the chamber is moved down over the die thereby further advancing the punch into the die and the billet through the annular opening to increase the length of tubing produced.

SUMMARY OF THE INVENTION

One of the objects of this invention is to provide improved apparatus and method for extruding material.

Another of the objects of this invention is to provide improved apparatus and method for producing tubing from a pierced billet.

Other and further objects of this invention will become apparent during the course of the following description and by reference to the accompanying drawing and the appended claims.

Briefly, apparatus is provided to establish an annular passageway having an entrance and converging toward an exit end, the width of the annular passageway at the entrance and being larger than the width at the exit end. A billet, provided with a longitudinal aperture, is advanced into the annular passageway along its longitudinal axis and is extruded through said annular passageway thereby to discharge tubing from the exit end of the said annular passageway.

BRIEF DESCRIPTION OF THE DRAWING

Referring now to the drawing in which like numerals represent like parts in the several views.

DESCRIPTION OF THE PREFERRED EMBODIMENT

Figure 1:
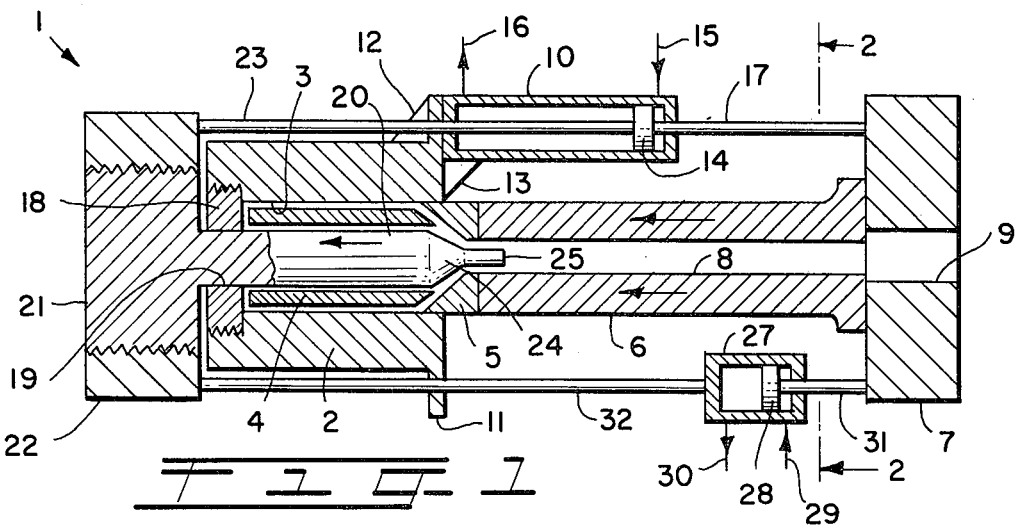
FIG. 1 represents a medial longitudinal section, partially diagrammatic, of apparatus constructed according to the present invention, showing a pierced billet in the pressure chamber at the beginning of an extrusion cycle and prior to passing through the die.

Extrusion apparatus 1 is seen as comprising pressure vessel 2 having formed therein a cylindrical pressure chamber 3 adapted to receive pierced billet 4 and slidably receiving die 5 mounted on ram 6. Ram 6 is secured, by suitable means such as welding, to plate 7. Apertures 8 and 9, extending through ram 6 and plate 7, respectively, are aligned with the longitudinal axis of the aperture in die 5.

Figure 2:
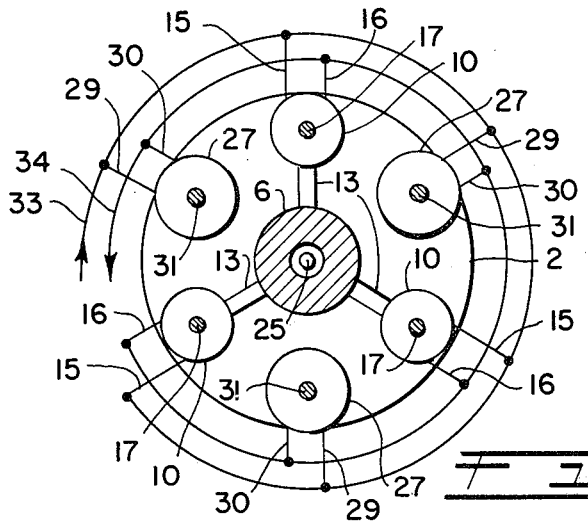
FIG. 2 represents a transverse section taken along the line 2—2 of FIG. 1, showing diagrammatically the piping arrangement for connecting in parallel all operating cylinders and adjustment cylinders.

Operating cylinders 10 are mounted to pressure vessel 2 in radially spaced relation as shown in FIG. 2. Advantageously, pressure vessel 2 is provided with a flange 11 on which the operating cylinders are seated and to which the said operating cylinders 10 may be secured by suitable means known in the art such as, for example, welding. Brackets 12 may be secured, by welding, to the side of pressure vessel 2 and to flange 11 opposite operating cylinders 10, radially displaced from the longitudinal axes of the said operating cylinders 10 for reasons which will hereinafter appear. Brackets 13 may be secured, by welding, to the front face of pressure vessel 2 and the sides of operating cylinder 10.

Each operating cylinder 10 is provided with a piston 14 and with fluid conduits 15 and 16 at opposite ends of the said operating cylinder 10. Fluid conduits 15 and 16 are connected, in the known manner, with a source of pressurized fluid and a return line or sump, whereby the piston 14 may be moved from one end to the other of the operating cylinder 10, depending on the piping connections made with the source of pressurized fluid and sump. A piston rod 17, slidably extending through an end of the operating cylinder 10, is connected at one end to the piston 14 and at the other end to plate 7. It will, therefore, be seen that by pressurizing with hydraulic fluid those chambers of operating cylinders 10 receiving piston rods 17, die 5 and ram 6 are advanced into pressure chamber 3, and by pressurizing with hydraulic fluid the opposite chambers of operating cylinders 10, die 5 and ram 6 are retracted from pressure chamber 3.

Figure 3:
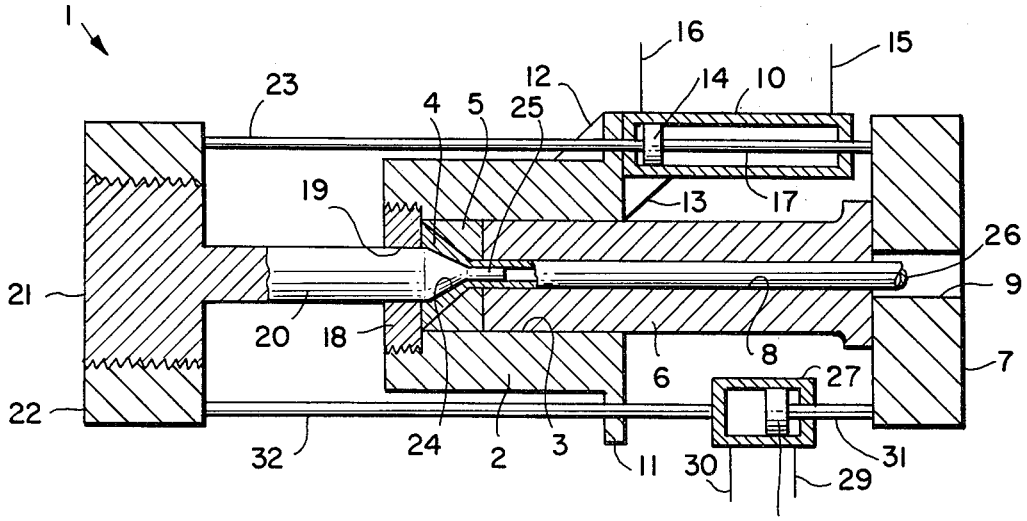
FIG. 3 represents a medial longitudinal section, partially diagrammatic, similar to FIG. 1, showing the apparatus at the end of an extrusion cycle with the die advanced into and the mandrel retraced from the pressure chamber and the billet extruded through the die to produce tubing.

Pressure vessel 2 is provided at its rear end with a threaded plug 18 having a diameter larger than the diameter of pressure chamber 3, the said plug 18 being screwed into the rear end of pressure vessel 2 as shown in FIGS. 1 and 3 and having a central aperture 19 slidably receiving mandrel 20 which extends through pressure chamber 3 into close proximity to die 5. The longitudinal axis of aperture 19 of plug 18, and hence the longitudinal axis of mandrel 20, are aligned with the longitudinal axis of pressure chamber 3 and with the longitudinal axes of the aperture in die 5 and of apertures 8 and 9. Mandrel 20 is mounted to threaded plug 21 which is screwed into plate 22. The threaded aperture in plate 22 which receives threaded plug 21 is larger in diameter than the diameter of threaded plug 18 so that, as hereinafter described, threaded plug 18 can pass through the said threaded aperture. Each operating cylinder 10 has a piston rod 23 which slidably extends through an end of the said operating cylinder 10 and through an aperture in flange 11, the said piston rod 23 passing laterally clear of bracket 12, one end of the piston rod 23 being connected to piston 14 in operating cylinder 10, opposite the point of attachment of piston rod 17 to the said piston 14, the other end of said piston rod 23 being connected to plate 22.

Mandrel 20 is provided with a conical section 24 which, when the apparatus 1 is assembled and ready to extrude or extruding, is located in the conical zone of deformation of die 5, and is also provided with a projection 25 extending through the aperture of die 5 into aperture 8 of ram 6. The transverse cross-section of the mandrel 20, including conical section 24 and projection 25, is circular as is the transverse cross-section of the zone of deformation and aperture of die 5. Conical section 24 of mandrel 20 and the zone of deformation of die 5 define therebetween an annular passageway which converges from the entrance end toward the exit end thereof, the said annular passageway also decreasing in width from the entrance end to the exit end thereof. The width of the annular passageway at the entrance end thereof is at least equal to, and preferably slightly greater than, the wall thickness of the pierced billet 4. The width of the annular passageway at the exit end thereof, and the difference between the radius of projection 25 of mandrel 20 and the radius of the central aperture in die 5, are equal to the wall thickness of the product tubing 26. It will be seen, therefore, that in extruding the billet 4 through the annular passageway as hereinafter described, tubing 26 having a smaller diameter and wall thickness than the billet 4 is produced.

The positions of mandrel 20 and die 5 are designed to be fixed relative to each other, thereby to fix the geometry of the annular passageway between the conical section 24 of mandrel 20 and die 5. Thus, when operating cylinders 10 are pressurized with hydraulic fluid in such a manner as to advance die 5 and ram 6 into the front end of pressure chamber 3 against billet 4, mandrel 20 is simultaneously retracted at the same velocity from pressure chamber 3 through the rear end thereof. As hereinafter described, adjustment cylinders 27 are provided and are operatively interposed between mandrel 20 and die 5 to compensate for forces which may be created during extrusion of the billet 4 through die 5, which forces if not compensated for might have the effect of stretching piston rods 17 sufficiently to change the geometry of the annular passageway between conical section 24 of mandrel 20 and die 5.

Adjustment cylinders 27 are radially spaced around pressure vessel 2, alternating with operating cylinders 10, as shown in FIG. 2. Each adjustment cylinder 27 is provided with a piston 28 and with fluid conduits 29 and 30 at opposite ends of the said adjustment cylinder 27. Fluid conduits 29 and 30 are connected, in the known manner, with a source of pressurized fluid and a return line or sump, whereby the piston 28 may be moved from one end to the other of the adjustment cylinder 27, depending upon the piping connections made with the source of pressurized fluid and the sump. A piston rod 31 slidably extending through an end of the adjustment cylinder 27, is connected at one end to the piston 28 and at the other end to plate 7. A tie rod 32, slidably extending through an aperture in flange 11, is connected at one end to that end of adjustment cylinder 27 opposite piston rod 31 and at the other end to plate 22. It will be seen that, by pressurizing with hydraulic fluid those chambers of adjustment cylinders 27 receiving piston rods 31, piston rods 31 and tie rods 32 will be subjected to tension tending to draw together plates 7 and 22.

Advantageously, fluid conduits 15 and 29, communicating, respectively, with those chambers of operating cylinders 10 receiving piston rods 17 and with those chambers of adjustment cylinders 27 receiving piston rods 31, are all connected to header 33, and fluid conduits 16 and 30, communicating, respectively, with the opposite chambers of the said operating cylinders 10 and adjustment cylinders 27, are all connected to header 34.

The operation of the invention will now be described.

Threaded plug 21 carrying mandrel 20 is unscrewed from plate 22, thereby removing the said mandrel 20 from pressure chamber 3 through aperture 19 of plug 18. Thereafter, threaded plug 18 is unscrewed from the rear of pressure vessel 2, thereby exposing pressure chamber 3. Header 34 is connected to a source of pressurized hydraulic fluid, and header 33 is connected to a return line or sump, whereby to operate operating cylinders 10 and adjustment cylinders 27 in such direction that die 5 and ram 6 are retracted from pressure chamber 3 and pistons 28 of adjustment cylinders 27 are shifted to their extreme right positions, all as shown in FIG. 1.

Pierced billet 4, the front end of which, advantageously, is tapered as shown in FIG. 1 to facilitate entry into the entrance end of the annular passageway between conical section 24 of mandrel 20 and die 5 and to facilitate the commencement of extrusion, is provided with a coating of die lubricating material (which may, for example, be castor oil or a wax such as beeswax or polyethylene wax) on its inner and outer surfaces, and is then inserted through the threaded aperture provided for threaded plug 21 in plate 22 and through the threaded aperture provided for threaded plug 18 in the rear end of pressure vessel 2 into pressure chamber 3.

Threaded plug 18 is now inserted through the threaded aperture provided for threaded plug 21 in plate 22 and screwed into the threaded aperture in the rear end of pressure vessel 2.

Mandrel 20 is inserted into aperture 19 of threaded plug 18, into pressure chamber 3 and into the aperture in pierced billet 4 and the threaded plug 21 to which the mandrel 20 is attached is then screwed into the threaded aperture in plate 22.

The piping connections to operating cylinders 10 and adjustment cylinders 27 are now reversed, so that header 33 is connected to the source of pressurized hydraulic fluid and header 34 is connected to the return line or sump, whereby to operate operating cylinders 10 in such direction that die 5 and ram 6 are forced into pressure chamber 3 to pressurize the pierced billet 4 and the die lubricating material on pierced billet 4 and extrude the billet material through the passage in the zone of deformation of die 5 defined by die 5 and the conical section 24 of mandrel 20, the product tubing 26 resulting from the said extrusion passing through apertures 8 and 9. Advantageously, the apparatus 1 is designed and operated so that there is a controlled flow of pressurized die lubricating material in the passage defined by die 5 and the conical section 24 of mandrel 20, this controlled flow of pressurized die lubricating material separting the material of billet 4 from mechanical contact with the surfaces of die 5 and conical section 24 and deforming the said material in the manner generally taught in my U.S. Pat. No. 3,677,048 (1972). It will be recognized that, when extruding billet 4 under extremely high pressure, forces tending to resist the advance the die 5 and ram 6 into pressure chamber 3 may be set up, these forces tending to stretch piston rods 17 and increase the width of the annular passageway between die 5 and conical section 24 of mandrel 20, thereby causing a lack of uniformity in tubing 26 and undesirable fluctuations in extrusion pressure. Such lack of uniformity may be unacceptable in the production of precision tubing 26. The preferred embodiment of apparatus 1 automatically compensates for this problem in that the adjustment cylinders 27, when pressurized in those chambers thereof receiving piston rods 31, bring plates 7 and 22 towards each other, reducing the tensile stresses in piston rods 17, sufficient to maintain constant the geometry of the annular passageway between die 5 and conical section 24 of mandrel 20, thereby to maintain constant the geometry of said annular passageway. Specifically, with operating cylinders 10 and adjustment cylinders 27 operated from the same pressurized fluid supply, the diameter of adjustment cylinders 27 is selected relative to the diameter of operating cylinders 10 so that, with the same pressurization in all cylinders 10 and 27, the adjustment cylinders 27 apply tension to piston rods 31 and tie rods 32 in an amount sufficient to compensate for or balance the stretch induced in piston rods 17 so that the net result is a constant geometry of the annular passageway between die 5 and conical section 24. It will be apparent to those familiar with the art that cylinder diameters will be a function of, among other things, diameters of piston rods and tie rods, materials of construction, etc. It will also be apparent to those familiar with the art that the length of adjustment cylinders 27 will generally be much less than the length of operating cylinders 10.

Extrusion of billet 4 is continued until die 5 approaches that portion of pressure chamber 3 adjacent threaded plug 18, whereupon operation of cylinders 10 and 27 is terminated and the process repeated as hereinbefore described.

What is claimed is:

1. Method of producing tubing from a billet having an aperture extending longitudinally therethrough, said method comprising:

a. placing said billet in a chamber;

b. inserting through a first end of said chamber into the aperture in said billet a mandrel;

c. positioning through a second end of said chamber a die in close proximity to said mandrel, said mandrel and said die cooperating to form an annular passageway having an entrance end and an exit end, said annular passageway converging from the entrance end toward the exit end thereof, the width of said annular passageway at the entrance end being larger than the width at the exit end;

d. advancing said die into said chamber against said billet while simultaneously retracting at the same velocity from the first end of said chamber said mandrel, whereby to advance said annular passageway into said chamber against said billet and extrude said billet through said annular passageway thereby to discharge tubing from the exit end of said annular passageway, said tubing having a smaller diameter and wall thickness than the billet; and e. maintaining the geometry of said annular passageway constant during extrusion of said billet therethrough.

2. Method as in claim 1, wherein:

f. step (e) is performed by applying at least one force urging said die and said mandrel toward one another, said at least one force having a magnitude sufficient to compensate for pressure tending to urge the die and mandrel apart during extrusion.

3. Method as in claim 1, wherein:

f. step (e) is performed by applying to at least one piston and cylinder assembly operatively interposed between said die and said mandrel a pressure urging the die and mandrel toward one another, said pressure having a magnitude sufficient to compensate for pressure tending to urge the die and mandrel apart during extrusion.

4. Method as in claim 1, further comprising:

f. prior to placing said billet in said chamber, coating the interior and exterior surfaces of said billet with die lubricating material.

5. Method as in claim 4, wherein:

g. step (f) is performed by coating said billet with castor oil.

6. Method as in claim 4, wherein:

g. step (f) is performed by coating said billet with beeswax.

7. Method as in claim 4, wherein:

g. step (f) is performed by coating said billet with polyethylene wax.

8. Method as in claim 4, wherein:

g. said billet is deformed in said annular passageway by flows of pressurized die lubircating material along the interior and exterior surfaces of said billet.

9. Apparatus for producing tubing from a billet having an aperture extending longitudinally therethrough, said apparatus comprising:

a. a chamber having a first end and a second end adapted to receive said billet;

b. a die having a zone of deformation leading to a central aperture through said die;

c. said chamber slidably receiving said die through the first end thereof;

d. a mandrel adapted to slidably extend through the second end of said chamber and into the aperture in said billet and into the zone of deformation of said die, said mandrel and said die defining an annular passageway having an entrance end and an exit end, said annular passageway being bounded by the zone of deformation of the die and converging from the entrance end thereof toward the exit end thereof, the width of said annular passageway at the entrance end being larger than the width at the exit end;

e. first means for advancing said die into said chamber through the first end thereof and against said billet and simultaneously retracting said mandrel from said chamber through the second end thereof in such manner that the velocity of the die entering the chamber equals the velocity of the mandrel exiting the chamber;

f. whereby to deform the billet in the annular passageway to produce tubing; and g. second means operatively interposed between the die and the mandrel for maintaining the positions of the mandrel and die constant relative to each other as the billet is deformed therebetween.

10. Apparatus as in claim 9, wherein:

h. the zone of deformation of said die is bounded by a cone extending rearwardly from the entrance end of said die, i. said mandrel has a conical section extending into the zone of deformation of said die.

11. Apparatus as in claim 9 wherein: h said first means comprises:

i. first hydraulic cylinder means, ii. first piston means in said first hydraulic cylinder means, iii. first piston rod means operatively interposed between one side of said first piston means and said die, iv. second piston rod means operatively interposed between the opposite side of said first piston means and said mandrel.

12. Apparatus as in claim 11, further comprising:

i. second means to adjust the positions of said die and mandrel relative to each other, said second means comprising:

i. second hydraulic cylinder means, ii. second piston means in said second hydraulic cylinder means, iii. third piston rod means and tie rod means operatively interposed between opposite sides of said second piston means and said die and mandrel.

13. Apparatus as in claim 12, wherein:

j. said first means comprises a plurality of said first hydraulic cylinder means, a plurality of said first piston means equal in number to the first hydraulic cylinder means and each associated with a different one of the first hydraulic cylinder means, a plurality of said first piston rod means equal in number to the first hydraulic cylinder means and each associated with a different one of the first hydraulic cylinder means, and a plurality of said second piston rod means equal in number to the first hydraulic cylinder means and each associated with a different one of the first hydraulic cylinder means, all arrayed in sets of associated elements spaced equiangularly about said die and said mandrel; and k. said second means comprises a plurality of said second hydraulic cylinder means, a plurality of said second piston means equal in number to the second hydraulic cylinder means and each associated with a different one of the second hydraulic cylinder means, and a plurality of said third piston rod means and tie rod means equal in number to the second hydraulic cylinder means and each associated with a different one of the second hydraulic cylinder means, all arrayed in sets of associated elements spaced equiangularly about said die and said mandrel.

14. Apparatus as in claim 13, wherein:

1. said second hydraulic cylinder means are equal in number to said first hydraulic cylinder means, are located radially equidistant from said die and said mandrel with the first hydraulic cylinder means and are interspersed alternatingly between the first hydraulic cylinder means.

* * * * *